US006715612B1

(12) United States Patent
Krystof

(10) Patent No.: US 6,715,612 B1
(45) Date of Patent: Apr. 6, 2004

(54) VIBRATOR ASSEMBLY

(75) Inventor: Staniak Krystof, Sorocaba (BR)

(73) Assignee: Manorex Limited (GB)

( * ) Notice: Subject to any disclaimer, the term of this patent is extended or adjusted under 35 U.S.C. 154(b) by 0 days.

(21) Appl. No.: 09/807,859

(22) PCT Filed: Oct. 21, 1999

(86) PCT No.: PCT/IB99/01820

§ 371 (c)(1),
(2), (4) Date: Apr. 19, 2001

(87) PCT Pub. No.: WO00/23202

PCT Pub. Date: Apr. 27, 2000

(30) Foreign Application Priority Data

Oct. 21, 1998 (ZA) ..... 98/9575

(51) Int. Cl.[7] ..... B07B 1/30
(52) U.S. Cl. ..... 209/331; 209/332; 209/364; 209/366
(58) Field of Search ..... 209/364, 365.1, 209/365.2, 365.4, 366, 331, 332, 333, 341, 337, 342

(56) References Cited

U.S. PATENT DOCUMENTS 2,964,186 A * 12/1960 Ferrara ..... 198/766
5,232,099 A * 8/1993 Maynard ..... 209/276
5,386,169 A * 1/1995 Dubruque ..... 209/276
5,802,965 A 9/1998 Lin
5,853,583 A * 12/1998 Shah ..... 210/340
5,896,998 A * 4/1999 Bjorklund et al. ..... 209/326
6,041,915 A * 3/2000 Fishman et al. ..... 209/346
6,070,737 A * 6/2000 Russell et al. ..... 209/326

FOREIGN PATENT DOCUMENTS

| | | |
|---|---|---|
| EP | 0185409 | 6/1985 |
| FR | 2604376 | 1/1988 |
| WO | 0023202 | 4/2000 |

* cited by examiner

*Primary Examiner*—Donald P. Walsh
*Assistant Examiner*—Joseph Rodriguez
(74) *Attorney, Agent, or Firm*—Baker Botts L.L.P.

(57) ABSTRACT

The invention provides a vibrator assembly (5) having a pair of vibrators (1) held in spaced apart relationship by a frame (10), screen assembly (1), having a screen (2, 3) extending between a pair of side plates (4), is securable between the vibrators (11) to the frame (10). The frame (10) transmits loadings transverse to the side plates (4) directly between the vibrators (11) to avoid undesirable stresses being absorbed by the screen assembly (1).

21 Claims, 2 Drawing Sheets

VIBRATOR ASSEMBLY

FIELD OF THE INVENTION

This invention relates to a vibrator assembly, more particularly, but not exclusively, to a vibrator assembly for use with equipment used in minerals classification and beneficiation, such as screens and feeders, hereinafter referred to as screens.

BACKGROUND TO THE INVENTION

Screens are widely used in the classification of solids. In minerals processing plants and quarries, large quantities of ore have usually to be classified as speedily and cost effectively as possible. In such plants it is thus common to find banks of super adjacent screens which are subject to vibration. Compactness is obtained by using banks of screens while screening efficiency is enhanced by vibration of the screens. When vibrated, a high volume throughput is obtained over a screen and is subjected to screening.

A number of methods are used to achieve vibration of screens, these may take the form of a vibrator secured on either side of a screen bank, usually to the side plates in which the screens are secured, the bank being mounted in turn on coil springs, rubber mounts or similar devices. Vibrators sometimes take the form of an electric motor driving an eccentrically weighted shaft.

There are most commonly two methods of vibration applied to the vibrating screens: the circular movement, or the linear movement.

Circular movement is more popular due to lower costs than the linear movement. It is most commonly obtained by rotating vibrators placed on the side plates or on a beam over or under the screening surface.

The linear movement is widely believed to have many advantages in the screening process. However, due to its higher production cost, their applications have been limited. The linear movement is usually obtained by two shaft geared to be synchronised and with the vibrating mechanism placed on beams over or under the screening surface or fixed directly to the side plates of a box construction of similar width to the screen.

Another way to obtain the linear movement by means of two shafts is by using the phenomena of self-synchronisation, when the two shafts do not need gears for synchronisation, it being sufficient that they are placed adequately and rotated with inverted rotation one to the other (one clockwise and the other counterclockwise). It is the most cost effective arrangement of self-synchronisation to place the vibrators fixedly on each side plate with the vibrating counterweight parallel to the side plate plane, and inclined in adequate angle.

This type of assembly has encountered difficulties due to high stresses introduced into the screen structure and only few manufacturers have made use of such arrangement, with limited success.

WO 93 19859 A (Sweco, Inc) describes a screen assembly with a screen secured between a pair of sideplates. A rotary eccentric vibrator mounted to each sideplates inclined to provide unidirectional elliptical vibratory motion to the assembly. Elliptical movement is less efficient than linear movement and the stresses introduced into the sideplates will probably be slightly less than those induced by linear movement. However, the applicant considers that the screen assembly disclosed will not endure with screens longer than 1 m due to stresses that will be developed in operation. These stresses will be particularly significant on the mounting plates for the vibrators and the mountings to the sideplates due to the turning moment caused by the vibrators. This patent further discloses a structural tube extending between the sideplates typical of many screen assemblies. The applicant views this tube as being ineffective in preventing damage to the sideplates as stresses will be transmitted through the sideplates prior to reaching the structural tube.

EP 0 185 409 A (Flow Control Service BV) discloses a pair of screen mats held in a tensioned condition between a pair of sideplates. Transverse tubes hold the sideplates in a spaced condition and assist in providing structural strength to the assembly. A rotary vibrator is secured centrally on each sideplate. This patent discloses the problem of stress fractures forming on screening apparatus and proposes to solve this problem by means the complex mounting arrangement for the vibrators. The applicant considers that fractures will still occur in the sideplates due to the transmission of the vibratory forces and that these will only be mitigated to a small extent by the transverse tubes.

U.S. Pat. No. 5,802, 965 (Lin) discloses a frame to which are secured a pair of vibrators and which in turn supports a bean sprout treating surface above the vibrators. The applicant is of the view that this assembly will have insufficient robustness for heavy loads.

FR 2 604 376 discloses a damper for vibrations between motors and screen assemblies but does not describe the manner in which a motor can be mounted to a screen or a manner by which stresses on screen assemblies can be reduced.

OBJECT OF THE INVENTION

It is the object of this invention to provide a vibrator assembly which will at least partially alleviate some of the abovementioned problems.

SUMMARY OF THE INVENTION

In accordance with this invention there is provided a vibrator assembly comprising a pair of vibrators held in spaced relationship by a frame to be securable to opposite side plates between which at least one screen extends, the frame shaped to transmit between the vibrators loadings generated by the vibrators which, in use, impart undesirable stresses to the screen assembly.

Further features of the invention provide for the screen to have a pair of side plates between which at least one screen extends; and for each side plate to be secured to a vibrator.

Further features of the invention provide for the frame to transmit loadings which are transverse to the side plates; for the frame to transmit loadings such that loadings transverse to the side plates are balanced; and for the vibrators to be arranged to impart linear motion to the screen assembly.

Still further features of the invention provide for the frame to have at least one, preferably two cross members, for the or each cross member to be tubular, preferably circular in cross-section; for the ends of the or each cross member to be pinched; for the or each cross member to operatively extend between the side plates; and for the or each cross member to have a flange at each end thereof to which a side plate is securable.

Yet further features of the invention provide for each vibrator to be secured to a flange securable to the or each cross member; for each vibrator to be secured to a carrier extending from the respective flanges; for each carrier to extend normally to the flange associated therewith; for the carriers to extend in a plane intersecting the longitudinal axis of the or each cross member; and for the carriers to be elongate with a vibrator secured to one end thereof and tapering towards the other end thereof.

Further features of the invention provide for each vibrator to include at least one, preferably two eccentrically weighted discs rotatably mounted on an axles to be driven through a shaft by a motor; for each motor to be secured to a side plate; alternatively for each motor to be free-standing; and for two or more screens to extend between the side plates in super adjacent configuration.

The invention further provides a screen assembly comprising at least one screen extending between a pair of side plates and secured to a vibrator assembly substantially as defined above.

The invention also provides a self-supporting frame for a vibrator assembly substantially as defined above.

A method of imparting linear vibration to a screen assembly comprising, mounting a screen assembly between a pair of vibrators operating the vibrators to impart linear motion in parallel planes to the screen and interconnecting the vibrators to dissipate between them loads generated transverse to the parallel planes of movement.

Further features of the invention provide for side plates on the screen assembly to be secured to the vibrators; for the vibrators to be interconnected by at least one cross-member extending between the side plates; and for the vibrators to be secured to the or each cross-member by fasteners.

BRIEF DESCRIPTION OF THE DRAWINGS

One preferred embodiment of a screen assembly will be described, by way of example only, with reference to the drawings in which.

DETAILED DESCRIPTION WITH REFERENCE TO THE DRAWINGS

Figure 1:
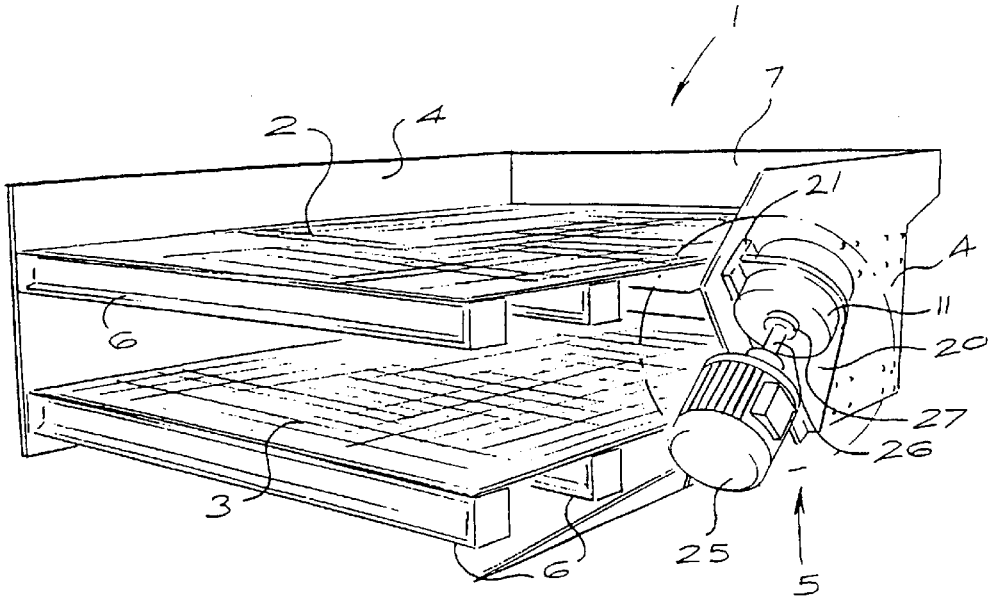
FIG. 1 is a part sectional oblique view of a screen assembly with a vibrator.
Figure 2:
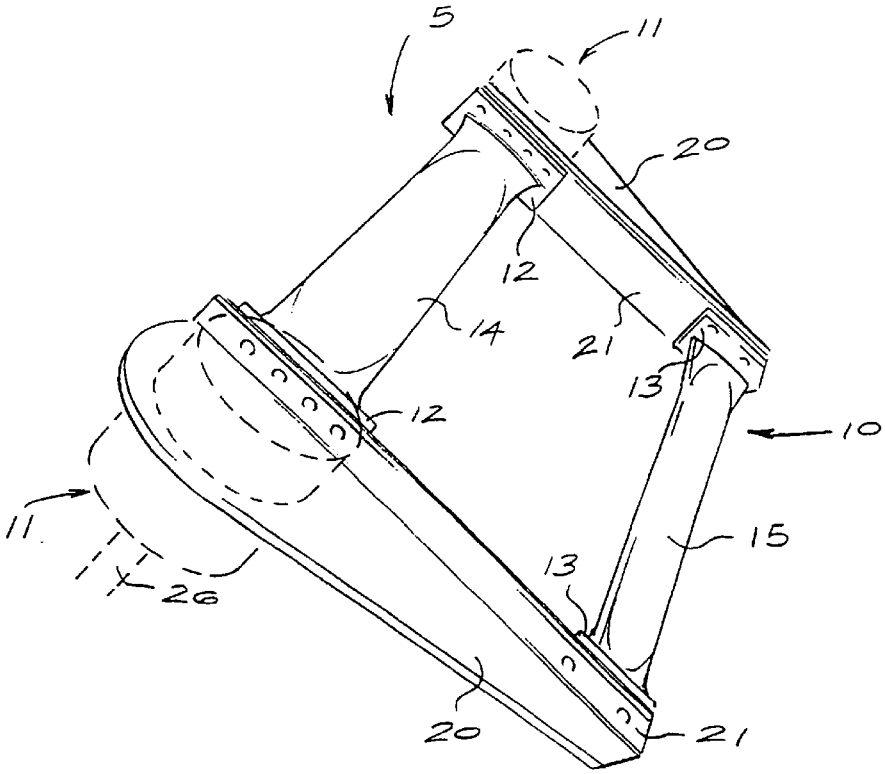
FIG. 2 is an oblique view of the vibrator in FIG. 1.
Figure 3:
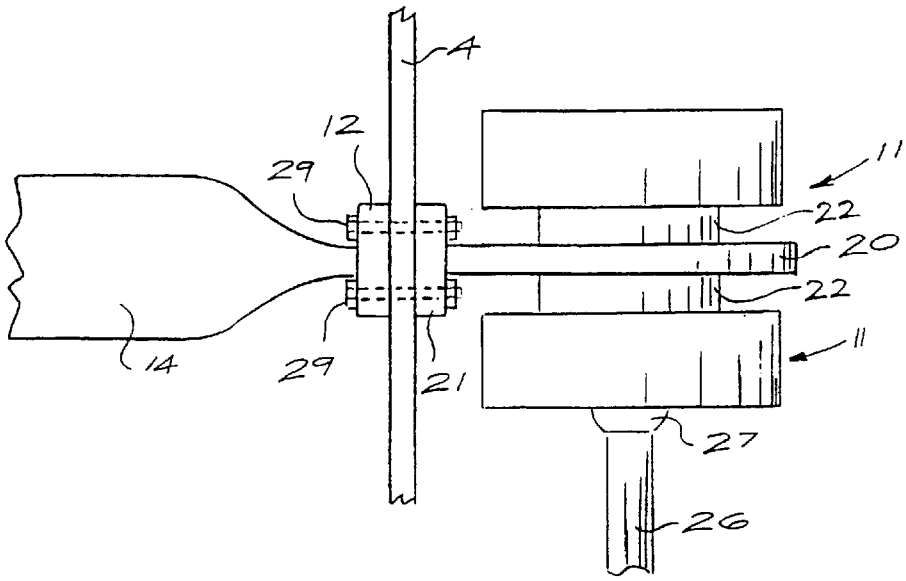
FIG. 3 is a part sectional elevation of part of the vibrator in FIG. 2.

A screen assembly (1) is shown in FIGS. 1, 2, and 3 and has a pair of screens (2,3) fixed in super adjacent relationship between a pair of side plates (4) with a vibrator assembly (5) secured thereto. The screens (2,3) extend substantially parallel to each other with each screen (2,3) locating on a set of elongate supports (6) extending between the side plates (4). A feed chute (7) is provided at one end of the uppermost screen (2) in conventional fashion. The side plates are supported at each of their lower most corners on coil springs (not shown).

The vibrator assembly (5) is shown more clearly in FIGS. 2 and 3 and has an independant frame (10) to which a pair of vibrators (11) are secured. The frame (10) has two pairs of flanges (12,13) spaced apart by a pair of parallel elongate cross members (14,15). The cross members (14,15) are cross-sectionally circular tubes which are pinched at their ends and welded to the respective flanges (12,13) as shown more clearly in FIG. 3. The cross members (14,15,) space the flanges (12,13) apart such that these operatively abut against the inner surfaces of the side plates (4).

Each vibrator (11) is secured to an elongate carrier (20), each carrier being secured to a flange (21) to extend normally thereto. Each carrier (20) extends the length of the flange (21) to which it is secured. The vibrators (11) are secured near one end of the respective carriers (20) which taper from that end towards the opposite end.

Each vibrator (11) has a pair of eccentrically weighted discs secured to an axle (not shown) rotatable in a housing (22), and each axle being rotatably secured to a carrier (20). An electric motor (25) is secured on a free standing bracket (not shown) adjacent each side plate (4) and connected by a drive shaft (26) and universal coupling (27) to the axle of a pair of eccentrically weighted discs. The flange (21) of each carrier (20) is secured by bolts (29) to a flange (12,13) on the cross members (14,15) with a side plate (4) intermediate the flanges and with the plane of the carriers (20) intersecting the longitudinal axes of the cross members (14,15) and parallel with the pinched ends thereof.

The frame of the vibrator assembly is of very rigid yet light construction. In use, the cross members transmit loadings which are transverse, usually perpendicular, to the side plates between the vibrators and dissipate these loads in the frame. This avoids these undesirable stresses being dissipated by the side plates and screen and consequently causing damage thereto. Also, the configuration of the carriers with respect to the cross members ensures that these loadings are balanced and so do not cause a turning moment about any point. The vibrator assembly thus has the result that the side plates and screens can be of very light construction, so avoiding the very heavy and robust structures previously required when mounting a vibrator on each of the side plates. Being of very light construction, the screen assembly also provides greater efficiencies than are currently achieved through conventional screen assemblies.

The vibrator assembly is particularly useful for linear vibration screens where loadings transverse to the side plates impart undesirable stresses to the screen assembly and in turn cause damage thereto. In this type of screen, the vibrators are synchronised to provide balancing transverse loads, and thus by causing the frame to transmit and dissipate these loads virtually no transverse loads are applied to the side plates and screens.

The invention thus provides a method of imparting linear vibration to a screen assembly which avoids the need for a heavy and very robust screen assembly construction. By interconnecting a pair of vibrators and mounting a screen assembly thereto, loads transverse to the desired direction of movement are dissipated by the means used for interconnection rather than in the screen assembly itself as occurs in the prior art.

Where the screen assembly has side plates, it is convenient to secure the vibrators on opposite side plates with at least one cross member, extending between the side plates connecting the vibrators, preferably by means of fasteners such as bolts. The use of fasteners has the advantage that especially outward transverse loads are directly imparted to the cross member rather than through side plates.

Figure 4:
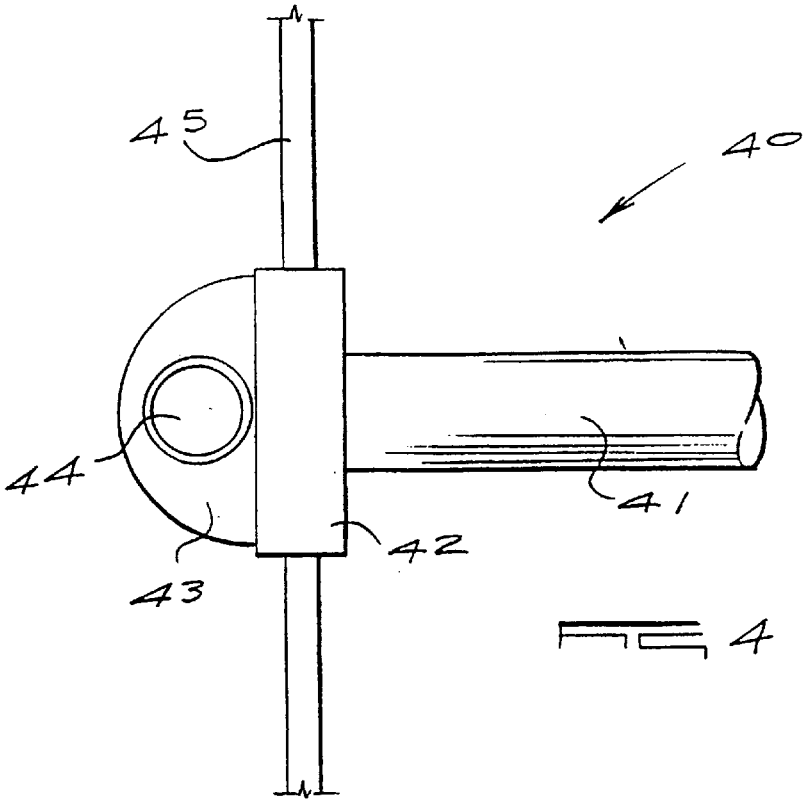
FIG. 4 is a part sectional elevation of part of a second embodiment of a vibrator assembly.

It will be appreciated, however, that many other embodiments of a screen assembly and method of imparting linear vibration to a screen assembly exist which fall within the scope of the invention especially as regards the configuration of the vibrator and screens. The frame of the vibrator assembly can have any suitable construction as can the vibrating means. For example, as shown in FIG. 4, the vibrator assembly (40) can have a single cross member (41) with a flange (42) at each end thereof (only one end shown).

A carrier (43) with a vibrator (44) is secured to each flange (42) opposite the cross member (41) and each flange (42) then secured in an aperture in a side plate (45). Similarly to the assembly described above, the vibrator assembly (40) allows loads transverse to the side plates (45) to be transmitted between the vibrators (44) and so avoids causing damage to the side plates.

Cross members used in the frame need not be circular in cross-section but could have any suitable configuration and could, for example, be made from channel sections.

What is claimed is:

1. A vibrator assembly comprising:

an independent frame assembly;

two or more vibrators, held in spaced relationship by the independent frame assembly, for imparting linear motion; and a screen assembly, securable which is secured and extends between the vibrators, wherein the screen assembly comprises at least one screen extending between a pair of sides plates and wherein the independent frame assembly is shaped to directly transmit between the vibrators transverse loadings generated by the vibrators in operation to thereby reduce undesirable stress to the screen assembly.

2. The vibrator assembly of claim 1, wherein when in operation, the frame transmits loadings which are transverse to the side plates.

3. The vibrator assembly of claim 1, wherein the frame has at least one cross member.

4. The vibrator assembly of claim 3, wherein the at least one cross member is tubular.

5. The vibrator assembly of claim 4, wherein the at least one cross member has a circular cross-section.

6. The vibrator assembly of claim 5, wherein the ends of the at least one cross member are pinched.

7. The vibrator assembly of claim 3, wherein the at least one cross member operatively extends between the side plates.

8. The vibrator assembly of claim 7, wherein the at least one cross member has a flange at each end thereof securable to a one of the side plates.

9. The vibrator assembly of claim 3, wherein each vibrator is secured to a flange which is further securable to the at least one cross member.

10. The vibrator assembly of claim 9, wherein each vibrator is secured to a carrier extending from the respective flange secured thereto.

11. The vibrator assembly of claim 10, wherein each carrier extends normally to the flange secured thereto.

12. The vibrator assembly of claim 10, wherein each carrier extends in a plane intersecting the longitudinal axis of the at least one cross member.

13. The vibrator assembly of claim 10, wherein each carrier is elongate with a vibrator secured to one end thereof and the carrier tapers towards the other end thereof.

14. The vibrator assembly of claim 1, wherein each vibrator includes at least one eccentrically weighted disc rotatably mounted on an axle which can be is driven through a shaft by a motor.

15. The vibrator assembly of claim 14, wherein each motor is secured to a one of the side plates.

16. The vibrator assembly of claim 14, wherein each motor is free-standing.

17. The vibrator assembly of claim 1, wherein said screen comprises a pair of super adjacent screens.

18. A method of imparting linear vibration to a screen assembly comprising the steps of:

mounting a screen assembly, such that said screen assembly is secured and extends between a pair of vibrators, wherein the screen assembly comprises at least one screen extending between a pair of sides plates;

operating the vibrators to impart linear motion in parallel planes to the screen; and interconnecting the vibrators with an independent assembly to dissipate between them loads generated transverse to the parallel planes of movement.

19. The method of claim 18, wherein the vibrators are interconnected by at least one cross member.

20. The method of claim 19, wherein the vibrators are secured to the at least one cross member by at least one fastener.

21. The method of claim 18, wherein said screen comprises a pair of screens, and further comprising the step of mounting said pair of screens super adjacent to each other.

* * * * *

UNITED STATES PATENT AND TRADEMARK OFFICE

CERTIFICATE OF CORRECTION

PATENT NO. : 6,715,612 B1
DATED : April 6, 2004
INVENTOR(S) : Staniak Krystof

It is certified that error appears in the above-identified patent and that said Letters Patent is hereby corrected as shown below:

Column 5,
Line 17, delete the word “securable”
Line 20, delete the “s” from the word “sides” and insert -- , wherein wach side plate is directly secured to one of the vibrators, -- after the word “plates”
Line 41, delete the word “a”

Column 6,
Line 27, insert -- securing one or jmore of the side plates of screen assembly directly to the vibrators; -- after the word “plates;”
Line 33, insert -- further comprising the step of interconnecting -- after the word “wherein”
Lines 33 and 34, delete the words “are interconnected”
Line 35, insert -- further comprising the step of securing -- after the word “wherein”
Lines 35 and 36, delete the words “are secured”

Signed and Sealed this

Seventh Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,715,612 B1
DATED : April 6, 2004
INVENTOR(S) : Staniak Krystof

It is certified that error appears in the above-identified patent and that said Letters Patent is hereby corrected as shown below:

Column 5,
Line 17, delete the word "securable"
Line 20, delete the "s" from the word "sides" and insert -- , wherein each side plate is directly secured to one of the vibrators, -- after the word "plates"
Line 41, delete the word "a"

Column 6,
Line 27, insert -- securing one or more of the side plates of screen assembly directly to the vibrators; -- after the word "plates;"
Line 33, insert -- further comprising the step of interconnecting -- after the word "wherein"
Lines 33 and 34, delete the words "are interconnected"
Line 35, insert -- further comprising the step of securing -- after the word "wherein"
Lines 35 and 36, delete the words "are secured"

This certificate supersedes Certificate of Correction issued September 7, 2004.

Signed and Sealed this

Nineteenth Day of October, 2004

JON W. DUDAS
*Director of the United States Patent and Trademark Office*